United States Patent [19]

Remmell et al.

[11] 4,142,695

[45] Mar. 6, 1979

[54] VEHICLE GUIDANCE SYSTEM

[75] Inventors: John A. Remmell, Sudbury; Frank Blitzer, Framingham; Robin L. Anderson, Sudbury; Robert G. Dietrich, Acton, all of Mass.

[73] Assignee: Raytheon Company, Lexington, Mass.

[21] Appl. No.: 193,012

[22] Filed: Oct. 27, 1971

[51] Int. Cl.[2] ..... F41G 7/14; F41G 9/00; F41G 7/00; F42B 15/10

[52] U.S. Cl. ..... 244/3.14

[58] Field of Search ..... 244/314, 316; 343/7 ED

[56] References Cited

U.S. PATENT DOCUMENTS 3,617,016 11/1971 Bolsey ..... 244/3.16

3,631,485 12/1971 Beazell, Jr. ..... 343/7 ED

*Primary Examiner*—Samuel W. Engle

*Assistant Examiner*—Thomas H. Webb

*Attorney, Agent, or Firm*—Richard M. Sharkansky; Joseph D. Pannone

[57] ABSTRACT

A vehicle guidance system wherein a vehicle is guided in either a command guidance mode or a homing guidance mode. In the command guidance mode, the target tracking element, used during the homing guidance mode serves as an inertial reference element. Such element is attitude stabilized in pitch and yaw by mechanically driven means used in both modes, such means driving the reference element with respect to the vehicle's body and, in roll, by the vehicle's roll autopilot to aerodynamically control the vehicle's attitude in roll.

5 Claims, 4 Drawing Figures

VEHICLE GUIDANCE SYSTEM

The invention herein described was made in the course of or under a contract or subcontract thereunder, with the Department of Defense.

BACKGROUND OF THE INVENTION

This invention relates generally to vehicle guidance systems wherein a vehicle is guided for a portion of its flight in a command guidance mode and for another portion of its flight in a homing guidance mode. More particularly, the invention pertains to such vehicle guidance systems wherein a reference element having a known attitude orientation is required to be contained within such vehicle.

As is known in the art, a vehicle, such as a missible, may be guided towards a target by guidance signals developed from tracking data obtained either at a remote radar station or by radar means contained within the missile. The former system is commonly called a command guidance system and the latter a homing guidance system. For example, in a command guidance missile system wherein a missile is used to intercept an airborne target, a large, remotely located high resolution radar system and high speed digital computer may be provided for selecting one of a plurality of targets, tracking both the missile and the selected target, calculating proper guidance signals for the missile from generated tracking data, and transmitting such calculated guidance signals to the missile. As is known, a reference element such as an attitude stabilized platform, having an angular orientation which is known at the remote station, is generally required to be contained within such missile for enabling transformation of the transmitted guidance signals into missile control signals. Further, in a homing guidance missile system a smaller, light weight, low power tracking radar system may be provided for generation of both target tracking data and guidance signals. Such low power tracking radar system (or at least the receiver portion thereof as in a semi-active application) may, because of its relative lighter weight, be contained within the missile. Generally, such homing guidance system includes a target tracking antenna. Such target tracking antenna is generally gimballed to substantially eliminate the effect of missile body rate on the tracking data.

In one type of known missile systems, the features of command guidance and homing guidance techniques are combined. During the early portion of the missile's flight guidance signals are developed by a digital computer operated in response to signals obtained by tracking both the missile and a selected target with a high resolution radar system. During the latter portion of the flight guidance signals are obtained by tracking the target with the radar receiver portion of a radar system fed by a gimballed tracking element carried by the missile.

For reasons discussed above, such missile would require an attitude reference element during at least the early portion of the missile's flight. One arrangement considered for providing such an attitude stabilized reference is to use an attitude stabilized platform. Such an arrangement requires, additionally, a gimballed radar receiving antenna having at least two degrees of freedom with respect to the missile's body for providing tracking data during the latter portion of the missile's flight. The attitude stabilized platform generally includes: (a) three rate sensing gyros disposed to measure angular rates about a respective one of three mutually orthogonal axes; and (b), three corresponding drive means controlled, respectively, by each one of the rate sensing gyros to rotate, relative to the missile's body, the platform in a manner so as to compensate for any angular rotation experienced thereby. A common mechanism for providing such drive means is a mechanical servo. Such servos are relatively costly and are generally relatively heavy.

SUMMARY OF THE INVENTION

With this background of the invention in mind it is an object of this invention to provide, for use in a vehicle guidance system wherein a vehicle is adapted to respond selectively to guidance signals derived from tracking data generated at a remote station and to tracking data generated by means contained within such vehicle, improved apparatus contained within the vehicle, such apparatus being adapted to provide both a reference element with a known angular orientation at the remote station and a gimballed tracking element.

It is another object of the invention to control the attitude of the above mentioned reference element without the use of three relatively costly and heavy mechanical servos.

These and other objects of the invention are attained generally by adapting the gimballed tracking element contained within a vehicle to function additionally as an attitude reference element, such element being stabilized by mechanical servo drives in pitch and yaw and stabilized by aerodynamical means in roll. In a preferred embodiment, a gimballed target tracking antenna on a missile having two degrees of freedom with respect to the vehicle's body has mounted thereon, in addition to its conventional pair of rate sensing gyros, a third rate sensing gyro. The three gyros are disposed to sense any angular change in the inertial orientation of the antenna. The output signals from each one of the conventional pair of rate sensing gyros are used as input signals for one of the mechanical servo drives coupled to the antenna. The output signals from the third rate sensing gyro are used as input signals to the missile's roll autopilot. The two servo drives and the roll autopilot thus function to attitude stabilize the antenna, such attitude stabilized antenna thus being adapted to serve as a reference element for enabling proper transformation of guidance signals transmitted between the missile and a remote station during at least a portion of the missle 'flight and as a target tracking antenna. The two servo drives and the missile's roll autopilot are also adapted to respond to signals transmitted to the missile from the remote station to position the reference element to any desired attitude orientation.

BRIEF DESCRIPTION OF THE DRAWINGS

These objects and many of the attendant advantages of the invention will be readily appreciated as the same becomes better understood by reference to the following detailed description when considered in connection with the accompanying drawings wherein.

DESCRIPTION OF THE PREFERRED EMBODIMENTS

Figure 1:
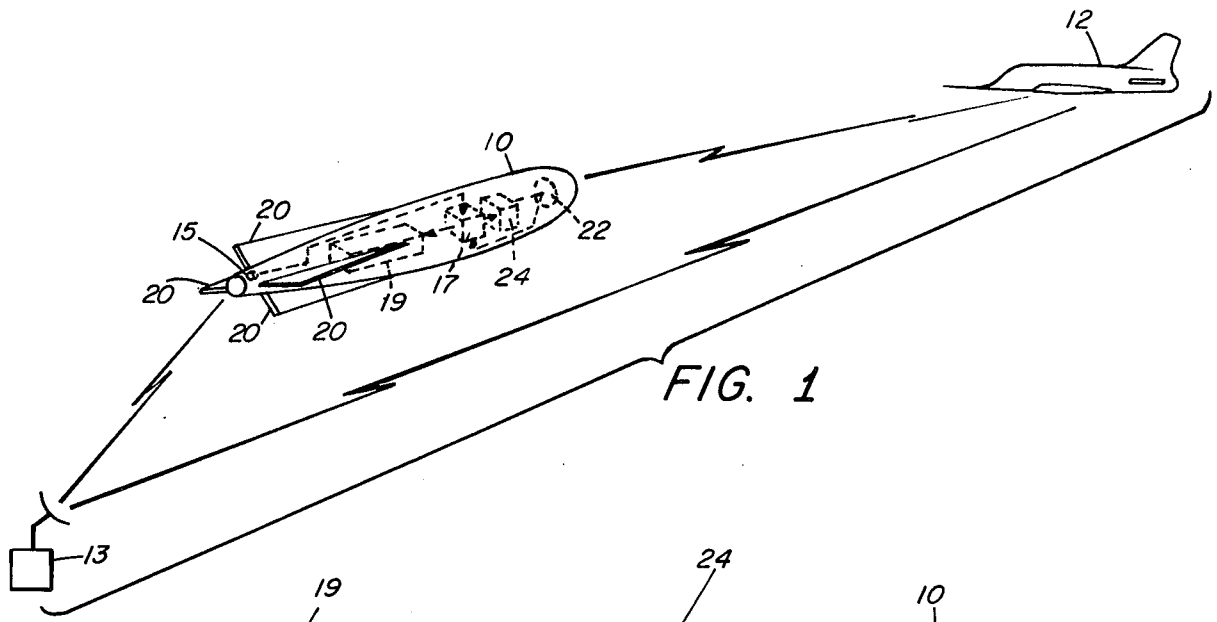
FIG. 1 shows a missile being guided towards a selected target by a guidance system using the principles of the invention.

Referring now to FIG. 1, a missile 10 is shown in flight being guided to intercept target 12 by responding either to guidance signals transmitted to the missile 10 from remote radar station 13 (as in a command guidance system) or to guidance signals developed by radar means contained within the missile 10 (as in a homing guidance system).

When operating in a command guidance mode, remote radar system 13 tracks both the missile 10 and the target 12. The tracking data obtained by such system are processed in a digital computer (not shown but located at the remote radar station) to convert such tracking data into guidance signals. The guidance signals are then transmitted to the missile 10. The transmitted guidance signals are received by a downlink antenna 15 and are then fed to receiver/processor 17 where they are converted into control signals for the missile's flight control section 19. It is readily apparent that the guidance signals computer at the remote radar station 13 are signals calling for missile 10 to maneuver in desired directions. Such guidance signals are convertd by the flight control section 19 to maneuver the missile 10. In particular, missile 10 here being cruciform, may be maneuvered in any lateral direction by controlling along two orthogonal axes (commonly called the pitch and yaw axes) pitch and yaw control surfaces 20, respectively. If follows then that the guidance signals calling for a maneuver of the missile in the desired direction must be resolved properly between the pitch and yaw control surfaces 20 to bring about such called-for maneuver. Such resolution may be made, provided the angular orientation of the wing surfaces 20 is known. Knowledge of the angular orientation of the wing surfaces 20 is possible by carrying within the missile 10 a reference element (to be described). Suffice it to say here that the angular orientation (i.e. attitude) of such reference element is known at the remote radar station 13.

When operating in a homing guidance mode the missile 10 is aligned so that its heading at the initiation of such mode is approximately along a collision course with target 12. The remote radar station 13 transmits radar frequency energy towards target 12. A portion of such radar frequency energy is reflected by target 12 and is received by the missile's tracking antenna 22. Signals representative of angular deviation of the target 12 from the boresight axis of target tracking antenna 22 are developed in a conventional manner and passed through receiver/processor 17 to both the target tracking antenna control section 24 and the flight control section 19. Such signals are used to drive the radar tracking antenna 22 so as to maintain track of target 12 and also to maneuver the missile 10 so as to maintain the missile on a collision course with such target 12. To put it another way, let it be assumed that the missile 10 is aligned along a collision course with the target 12 and the boreshight axis of the target tracking antenna 22 is pointing at the target 12, then if the missile 10 stays on the collision course the boresight axis of the target tracking antenna 22 will remain pointing at the target 12. However, if the missile 10 deviates from such collision course (for example, if the target 12 maneuvers) the boresight axis of the target tracking antenna 22 will no longer be pointed at target 12. That is, a boresight error will then be developed, such boresight error being proportional to the change in line of sight angle between the missile 10 and target 12. It is immediately apparent that the target tracking antenna 22 must be driven to null out such boresight error to prevent losing track of target 12. Further, as is known in proportional navigation guidance, it is desirable to have the missile 10 turn from its present flight path at a rate proportional to the rate of change in such line of sight angle. The missile turn rate is produced by having the missile accelerate laterally (i.e. normal to the line of sight) in a direction to null the change in the line of sight angle. That is, the missile 10 must maneuver to get back on a collision course with target 12. The lateral acceleration of the missile 10 is produced by deflecting selected control surfaces 20. In particular, the tracking of the target 12 by the radar tracking antenna 22 and the maneuvering of the missile 10 to maintain such missile on a collision course is accomplished by developing a signal representative of the boresight error and feeding such signal to both flight control section 19 and target tracking antenna control section 24.

It is here noted that the target tracking antenna 22 is gimballed in two degrees of freedom with respect to the missile's body. Such gimballing is here accomplished in a conventional way by mounting two rate sensing gyros to such antenna to sense the inertial rates experienced thereby and by providing drive means to move the target tracking antenna 22 relative to the body of the missile 10. The target tracking antenna 22 is gimballed to prevent the missile's body motion from developing an erroneous boresight error signal.

Figure 2:
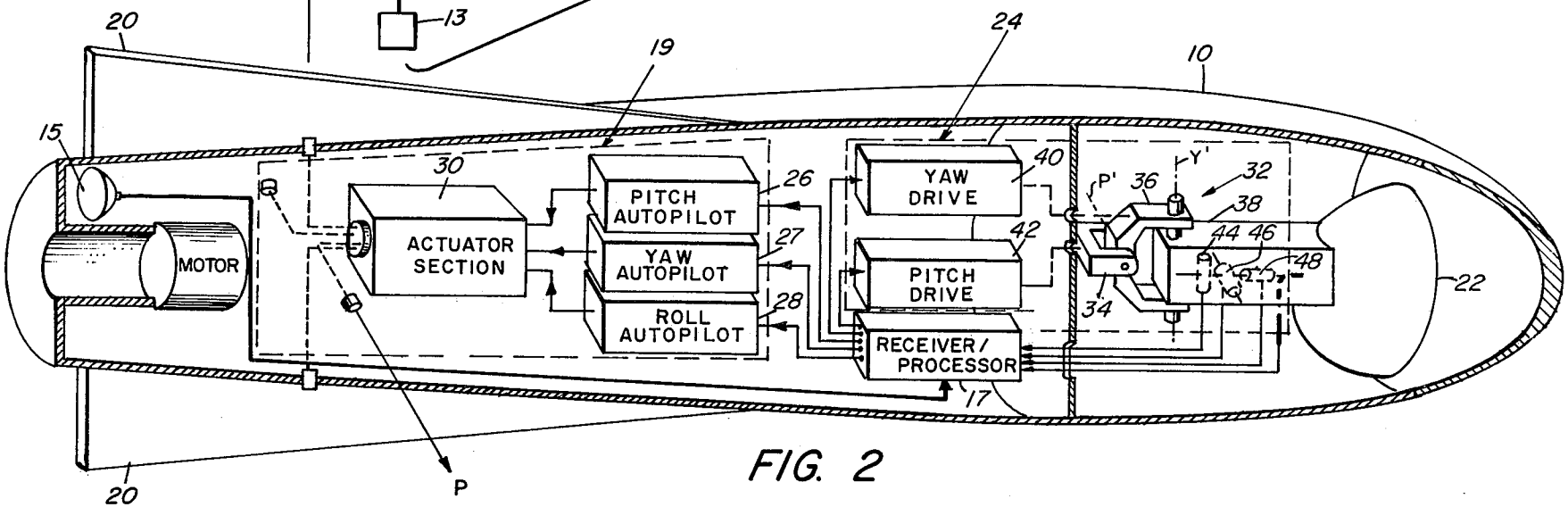
FIG. 2 shows a block diagram of the main portions of guidance control elements carried by the missle and their relationship to a target tracking antenna.

Referring now to FIG. 2, flight control section 19 is shown to include pitch, yaw and roll autopilots 26, 27, 28, each one of such autopilots being controlled by receiver/processor 17. The output signals from each one of such autopilots is fed to an actuator section 30. The pitch, yaw and roll autopilots 26, 27 and 28 may be of any conventional design. The actuator section 30 may also be of any conventional design. The actuator section is mechanically coupled to control surfaces 20. The control surfaces 20 are pivotably mounted to the missile's body. Deflection of one pair of opposing control surfaces (called pitch control surfaces, i.e. those driven by the pitch autopilot) produce maneuvers of the missile about a pitch axis P and deflection of the other pair of control surfaces (called the yaw control surfaces, i.e. those driven by the yaw autopilot) produce maneuvers of the missile about a yaw axis Y. The differential deflection of one pair of control surfaces, say the pitch control surfaces, produce rolling of the missile 10 about its longitudinal axis. Such differential deflection is produced when the actuator section 30 responds to command signals from the roll autopilot 28.

Target tracking antenna control section 24 includes a structure 32 to which the target tracking antenna 22 is mounted. Structure 32 is designed to enable the target tracking antenna 22 to move with two degrees of freedom within the missile. In particular, such structure 32 includes a base 34 suitably affixed to the missile body. An outer member 36 is pivotly mounted to the base 34 so as to rotate about an antenna pitch axis, P', such axis being parallel to pitch axis P. Inner member 38 is pivotly mounted to outer member 36 so as to rotate about an antenna yaw axis, Y', such axis being perpendicular to antenna pitch axis P'. Affixed to such inner member 38 is the target tracking antenna 22. The boresight axis of such antenna is mutually orthogonal to the antenna pitch axis P' and the antenna yaw axis Y'. Target tracking antenna 22, which may be any conventional target tracking antenna, here is a monopulse antenna. Therefore, a pair of signals is produced by such antenna, one of such pair of signals representing a component of the boresight error along antenna pitch axis, P', one of the pair of signals representing the component of such boresight error along the antenna yaw axis, Y'. The outer and inner structures 36, 38 are coupled to the output of pitch drive 42 and yaw drive 40, respectively, in any convenient way (here shown by dotted lines). That is, the yaw drive 40 pivots the inner structure 38 about the antenna yaw axis Y'. Likewise, the pitch drive 40 pivots the outer structure 36 about the antenna pitch axis, P'. The yaw and pitch drives 40, 42 may be electrical or mechanical motors responsive to electrical signals supplied by receiver/processor 17. Three antenna rate sensing gyros 44, 46, 48 are mounted to the inner structure 38. The input axis of each one of the three antenna rate sensing gyros are disposed along mutually orthogonal axes. In particular, antenna rate sensing gyros 44, 46 and 48 are oriented so that the output signals from each one of such gyros represnts, respectively, the angular rate of the target tracking antenna 22 about antenna yaw axis Y', antenna pitch axis P' and its boresight axis. It is therefore apparent that the output signals also provide a measure of the inertial angular rate of structure 32.

Figure 3:
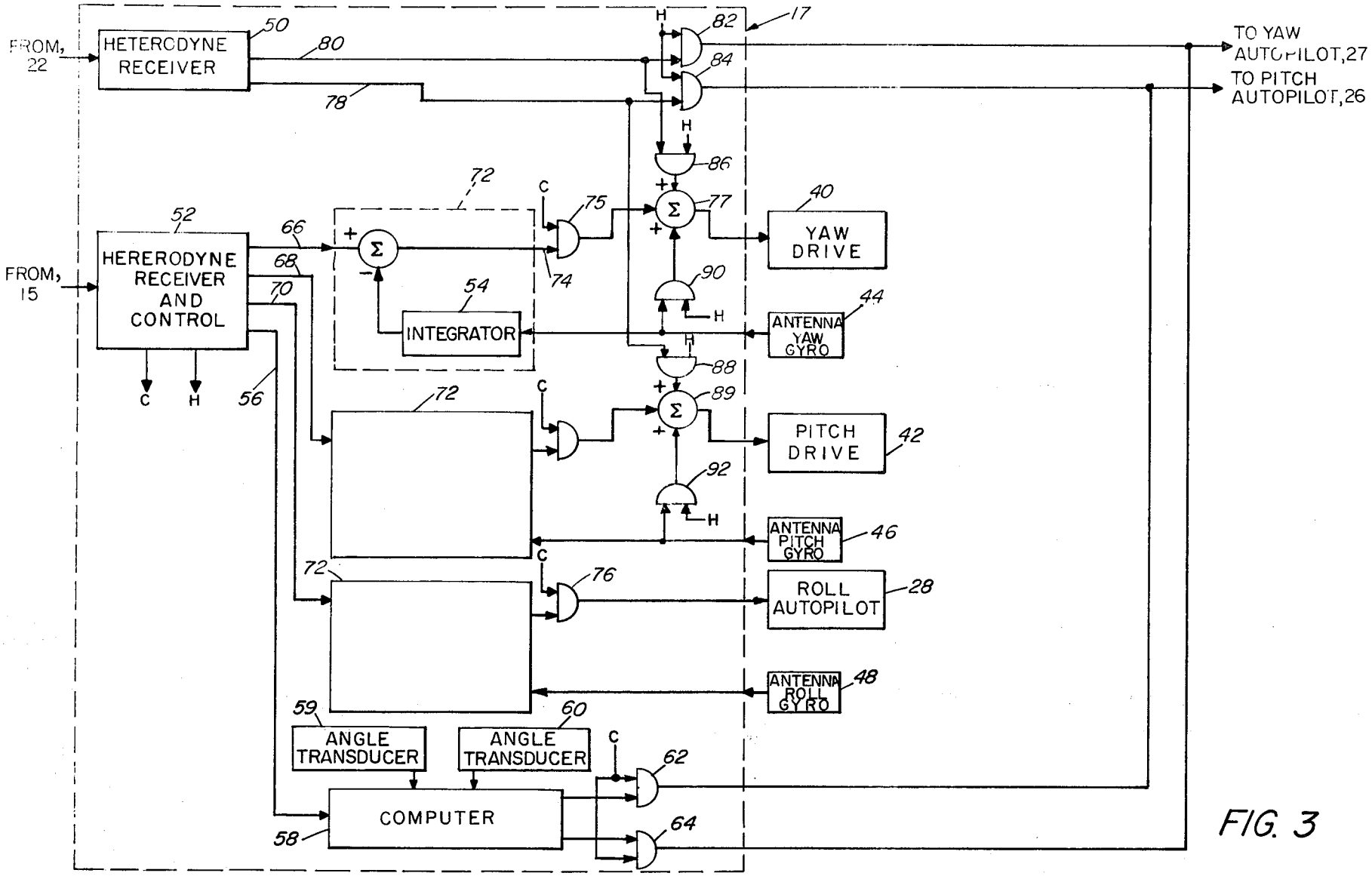
FIG. 3 shows in some detail the receiver/processor of FIG. 2.

Referring now to FIG. 3, receiver/processor 17 is seen to include a heterodyne receiver 50 fed by target tracking antenna 22 and and a heterodyne receiver and control 52 fed by the downlink antenna 15. Heterodyne receiver and control 52 produces gating signals on either line H or line C in accordance with the guidance mode required for the missile 10. This is, during the homing guidance mode line H has a gating signal applied to it, whereas during the command guidance mode line C has a gating signal applied to it.

Let it be assumed that missile 10 is launched in the command guidance mode. It will be first noted that signals from the heterodyne receiver 50 (i.e. from target tracking antenna 22) are inhibited from passing to either the flight control section 19 or the target tracking antenna control section 24. It will be further noted that the structure 32 is attitude stabilized and therefore may be considered as a reference element. That is, during the command guidance mode, inertial rates experienced by the structure 32 are sensed by antenna rate gyros 44, 46, 48 and signals representative of such inertial rates are fed to means (to be described) for returning the structure 32 to the angular orientation it has prior to experiencing such inertial rates. In particular, the signals representative of inertial rates about the antenna yaw axis Y' and antenna pitch axis P' sensed by antenna rate sensing gyros 44 and 46 are fed, respectively, through integrators 54 to yaw drive 40 and pitch drive 42. The roll orientation of structure 32 is attitude stabilized by coupling the output signals from antenna rate gyro 48 to roll autopilot 28. The roll inertial stabilization of the missile 10 through use of the roll autopilot 28 is possible because the aerodynamic response of the missile 10 to differential deflection of the pitch control surfaces is fast enough to inertially stabilize the structure 32 in roll. Therefore, because a reference element having an angular orientation which is known at the remote radar station 13 (FIG. 1) is contained within missile 10, such missile may be guided with guidance signals transmitted from remote radar station 13. In particular, guidance signals transmitted from the remote radar station 13 are received by downlink antenna 15 and then processed by heterodyne receiver and control 52. Such guidance signals contain the following information: (1) the guidance mode in which the missile should operate (i.e. command or homing) as determined by the range of the missile 10 from the target 12; (2) the maneuver signals being referenced to the known angular orientation of the reference element (i.e. structure 32); and (3) command signals for positioning structure 32 in a known orientation to constrain such structure within limits allowable by the physical space provided for it within the missile 10. Guidance mode selection information is used to determine whether a gating signal should be applied to line C or to line H. Maneuver signals are converted into electrical signals on line 56, such signals being fed to a computer 58 where they are converted into acceleration commands referenced to the orientation of the control surfaces, 20, (i.e. the orientation of the missile's body). The conversion of the maneuver signals from "reference element" coordinates to "missile body" coordinates is made by providing in the missile 10 conventional angle transducers 59, 60. Such transducers are suitably mounted to provide a measure of the orientation of the inner element 38 and outer element 36 with respect to the missile's body. The output of such transducers 59, 60 are fed to computer 58 together with the maneuver signals on line 56. The properly resolved signals pass through gates 62 and 64 to pitch and yaw autopilots 26, 27. Command signals for positioning structure 32 in a known orientation are processed by heterodyne receiver and control 52 and appear as angle command signals on lines 66, 68, 70. Such signals are fed to error computers 72. Let us consider the signal on line 66. Such signal represents the desired "yaw" position of the structure 32 in inertial space. The output of integrator 54 is a signal representative of the actual "yaw" position of the structure 32 in inertial space. If the "desired" position and the "actual" position are not equal an error signal appears on line 74. Such error signal passes through gate 75 and a summer 77 to yaw drive 40. Command of the "pitch" position of structure 32 is accomplished in a similar way as shown. For roll, however, the "error signal" out of the error computer 72 is fed through rate 76 to the roll autopilot 28. The roll autopilot 28 develops signals in response to such "error signal" whereby the pitch control surfaces are differentially deflected. The missile's roll attitude is thereby changed because of such differential deflection of the pitch control surfaces, such differential deflection continuing until the "error signal" is nulled. Let us now assume that the range between the missile 10 and target 12, as determined by the remote tracking station 13, has been reduced to where it is desirable to have such missile guide in the homing guidance mode. The missile may be assumed to be aligned along an approximate collision course with target 12. A signal is transmitted to missile 10 from such remote station whereby heterodyne receiver and control 52 produces a gating signal on line H and removes the gating signal from line C. Therefore, signals from error computers 72 and computer 58 are inhibited from passing to yaw drive 40, pitch drive 42, roll autopilot 28, pitch autopilot 26 and yaw autopilot 27. The yaw boresight error signals and pitch boresight error signals developed by the target tracking antenna 22 are heterodyned in heterodyne receiver 50 to produce video frequency signals. The video frequency signals corresponding to the pitch boresight error and yaw boresight error appear on lines 78, 80, respectively. Such signals are fed, respectively, to the pitch autopilot 26 and yaw autopilot 27 through gates 82 and 84, as shown. The signals on line 80 are also fed through gate 86, via summer 77, to yaw drive 40 and the signals on line 78 are fed through gate 88, via summer 89, to pitch drive 42 so that target tracking antenna 22 may maintain track of target 12. Signals from the antenna yaw gyro 44 are through gate 90 to the yaw drive 40 additionally with the signals passing through gate 86. Likewise signals from the antenna pitch gyro 46 are fed through gate 92 to pitch drive 40 additionally with the signals passing through gate 88. The signals from such antenna pitch and yaw gyros 44, 46 are used therefore to sense the inertial rates of target tracking antenna 22 and thereby such antenna with respect to the missile's body for reasons previously discussed.

Figure 4:
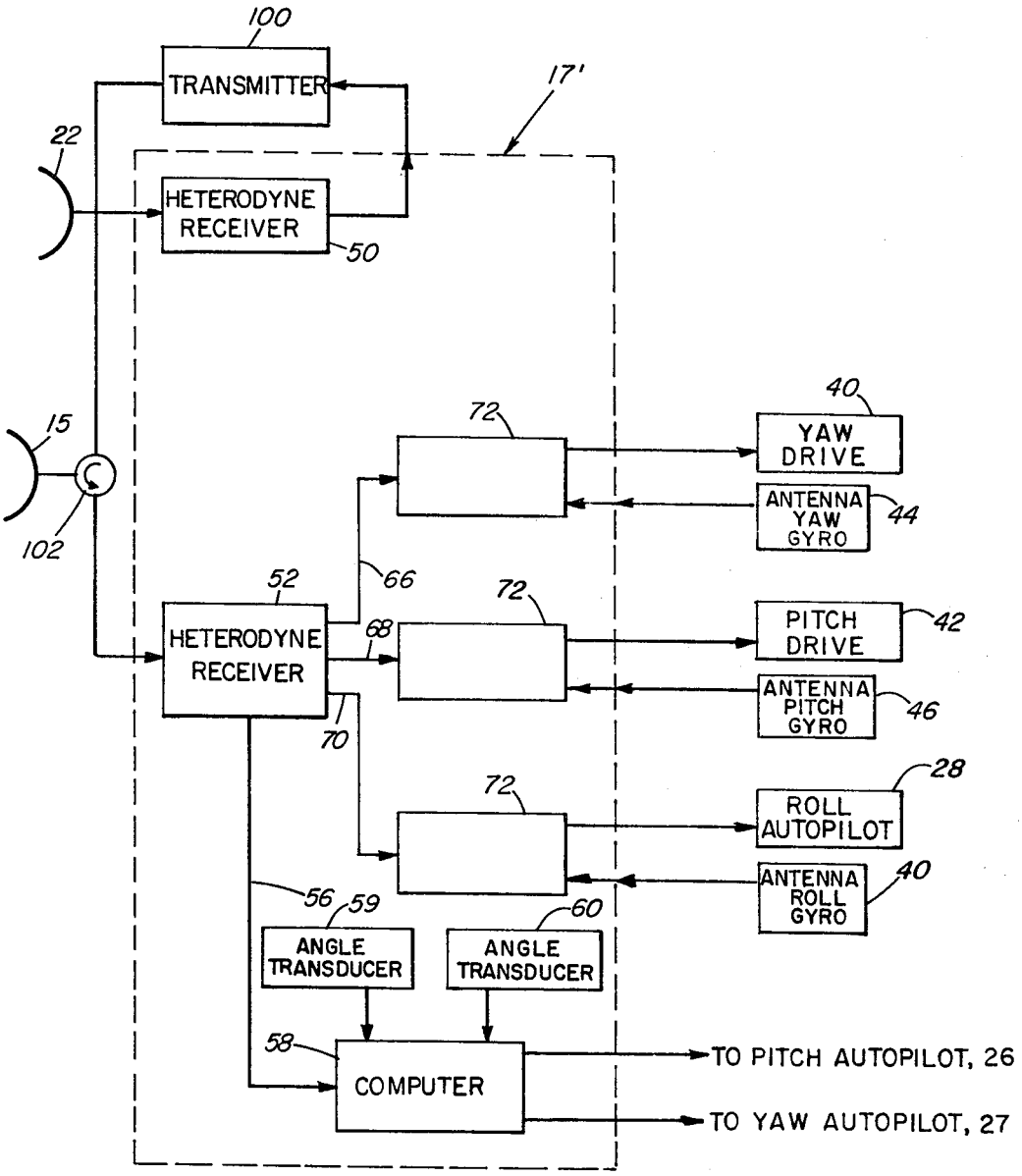
FIG. 4 shows an alternative embodiment of the invention.

Referring now to FIG. 4, an alternative embodiment employing the features of the invention is shown. In such embodiment missile 10 is shown as operating in the command guidance mode. However, the tracking signals are generated from the signals received by the target tracking antenna 22 rather than signals received from the target at the remote radar station 13. Thus signals received by target tracking antenna 22 are fed to heterodyne receiver 50 and then are retransmitted by transmitter 100 back to the remote radar station 13. The signals from transmitter 100 pass through circulator 102 and downlink antenna 15 to the remote tracking station 13. Such retransmitted signals are processed by the computer at the remote radar station 13 to determine guidance signals for the missile. Such guidance signals are transmitted from the remove radar station 13 and are received by downlink antenna 15. The signals received by downlink antenna 15 are processed and responded to by the missile in the manner described in reference to FIG. 3. It is here noted that the target tracking antenna 22 (and structure 32) serve, in addition to a target tracking element, as the reference element required during the command guidance mode. The orientation control and inertial stabilization of such reference element is achieved by means equivalent to those previously discussed in the command guidance mode of FIG. 3.

While the invention has been described using rate sensing gyros affixed to the target tracking antenna 22, it will now be apparent to one of ordinary skill in the art that such gyros and the integrators coupled thereto may be replaced by rate integrating gyros. It is felt, therefore, that this invention should not be restricted to the proposed embodiments, but rather should be limited only by the spirit and scope of the following claims.

We claim:

1. In a vehicle guidance system, wherein a vehicle is guided during a portion of flight towards a selected target in a command guidance mode and during another portion of the flight in a homing guidance mode, apparatus comprising:

(a) target tracking means, including a target tracking element carried by the vehicle, for generating guidance signals for the vehicle during the homing guidance mode;

(b) first means, affixed to the target tracking element, for sensing the inertial angular rates of such element about a pitch axis and a yaw axis;

(c) means, responsive to the first means, for gimballing the target tracking element with respect to the vehicle's body about the pitch axis and the yaw axis;

(d) second means, affixed to the target tracking element, for sensing the inertial angular rate of such target tracking element about an axis mutually orthogonal to the pitch axis and the yaw axis; and (e) means, responsive to the first means and the second means, for stabilizing the attitude of the target tracking element at a known angular orientation during the command guidance mode.

2. The apparatus recited in claim 1 wherein the stabilizing means includes means, responsive to the second means, for controlling the attitude of the vehicle aerodynamically in accordance with the inertial angular rate sensed by such second means.

3. The apparatus recited in claim 2 wherein the controlling means is a roll autopilot carried within the vehicle.

4. The apparatus recited in claim 1 including stabilizing means, coupled to the gimballing means and the stabilizing means, for positioning the target tracking element at a predetermined angular orientation.

5. The apparatus recited in claim 4 wherein the positioning means includes means coupled to the first means and the second means, for integrating the inertial angular rates about the pitch axis, the yaw axis and the axis mutually orthogonal thereto.

* * * * *

UNITED STATES PATENT OFFICE
CERTIFICATE OF CORRECTION

Patent No. 4,142,695 Dated March 6, 1979

Inventor(s) John A. Remmell et al

It is certified that error appears in the above-identified patent and that said Letters Patent are hereby corrected as shown below:

Column 2, line 67, delete "missle" and replace with -- missile --;

Column 3, line 64, delete "boreshight" and replace with -- boresight --;

Column 5, line 54, delete "has" and replace with -- had --;

Column 7, line 36, delete "remove" and replace with -- remote --.

Signed and Sealed this

*First* Day of *April 1980*

[SEAL]

*Attest:*

SIDNEY A. DIAMOND

*Attesting Officer*

*Commissioner of Patents and Trademarks*